US007619580B2

(12) United States Patent
Lenart et al.

(10) Patent No.: US 7,619,580 B2
(45) Date of Patent: Nov. 17, 2009

(54) ANTENNA FEEDING NETWORK

(75) Inventors: Gregor Lenart, Täby (SE); Jens Malmgren, Cannes-la-Bocca (FR)

(73) Assignee: Cellmax AB, Täby (SE)

( * ) Notice: Subject to any disclaimer, the term of this patent is extended or adjusted under 35 U.S.C. 154(b) by 93 days.

(21) Appl. No.: 11/578,302

(22) PCT Filed: Apr. 15, 2005

(86) PCT No.: PCT/SE2005/000548

§ 371 (c)(1),
(2), (4) Date: Dec. 13, 2006

(87) PCT Pub. No.: WO2005/101566

PCT Pub. Date: Oct. 27, 2005

(65) Prior Publication Data

US 2007/0205954 A1 Sep. 6, 2007

(30) Foreign Application Priority Data

Apr. 15, 2004 (SE) ..... 0400975-9

(51) Int. Cl.
*H01Q 9/38* (2006.01)
*H01Q 1/00* (2006.01)

(52) U.S. Cl. ..... 343/830; 343/905

(58) Field of Classification Search ..... 343/830, 343/850, 905, 906
See application file for complete search history.

(56) References Cited

U.S. PATENT DOCUMENTS 2,760,193 A * 8/1956 Riblet ..... 343/821
6,118,353 A * 9/2000 McKay ..... 333/125
6,222,499 B1 * 4/2001 Goetz et al. ..... 343/860
6,356,245 B2 * 3/2002 Metzen et al. ..... 343/905

OTHER PUBLICATIONS

Hideyuki, O. et al.: "Broadband Directional Coupler Using Dielectric Loaded Slit". Ieee mtt-s Digest, 1993, pp. 873-876.

* cited by examiner

*Primary Examiner*—Shih-Chao Chen

(57) ABSTRACT

An antenna feeding network including at least one antenna feeding line, each antenna feeding line including a coaxial line having a central inner conductor and a surrounding outer conductor. The outer conductor (4) is made of an elongated tubular compartment (5) having an elongated opening (6) along one side of the compartment (5), and that the inner conductor (3) is suspended within the tubular compartment (5) by dielectric support elements (7).

20 Claims, 5 Drawing Sheets

4a

4b

5a

5b

ANTENNA FEEDING NETWORK

BACKGROUND OF THE INVENTION

A typical communications antenna consists of a number of radiating elements, a feeding network and a reflector. The purpose of the feeding network is to distribute a signal from a single connector to all dipoles. The feeding network usually consists of controlled impedance transmission lines. The antenna needs to be impedance matched to a pre-defined value, usually 50 ohm or 75 ohm, otherwise power fed into the antenna will be reflected back to its source instead of being radiated by the dipoles, with poor efficiency as a result.

The signal needs to be split between the dipoles in a transmission case, and combined from the dipoles in a reception case, see FIG. 1. This is usually done using the same network, which is reciprocal. If the splitters/combiners consist of just one junction between 50 lines, impedance match would not be maintained, and the common port would be 25 ohm instead of 50 ohm. Therefore the splitter/combiner usually also provides an impedance transformation circuit that gives 50 ohm impedance at all three ports.

Some manufacturers use coaxial lines with square cross-section tubes, as an outer conductor, together with a circular central conductor, as an inner conductor. The impedance of the line depends on the ratio between the outer conductor and the inner conductor, and what type of dielectric material that is used, see FIG. 2.

Connections between the lines, here called "cross-overs", are usually made using holes between the lines, and impedance matching is done by varying the diameter of the inner conductor. In such a way, the impedance transformation necessary for the splitter/combiner can be realized.

The inner conductor is suspended in the square tubes using small pieces of dielectric support means, for example polytetrafluoroethylene (PTFE). These dielectric support means are made as small as possible in order to maintain the line impedance. The necessary impedance transformation is obtained by machining.

Also losses within the antenna must be kept to a minimum in order to obtain a high system receiver sensitivity, and transmitting efficiency. Losses in the antenna are mainly due to impedance mismatch or losses in the antenna feeding network.

The inherent problem with all these technologies is that all dielectric support means except air introduce losses. Also, with those technologies, large dimensions of network are difficult to realize. Two things are needed to minimize losses in the feeding network. Firstly the dimensions of the transmission lines must be as large as possible in order to reduce resistive losses. Secondly the dielectric, used in the lines, shall have low losses.

One drawback with this design is that the inner conductor, that forms the central conductor, must be machined which is a costly process. Also, tuning is tedious, as it has to be done by re-machining the inner conductor.

Another drawback is that the connections between the lines are made using holes between the compartments, which also make assembly tedious, and it is difficult to inspect the result. It is also difficult to maintain the correct impedance. Bad assembly introduces intermodulation.

SUMMARY OF THE INVENTION

Present invention refers thus to an antenna feeding network, including at least one antenna feeding line, each antenna feeding line comprising a coaxial line having a central inner conductor and a surrounding outer conductor, and is characterised in, that the outer conductor is made of an elongated tubular compartment having an elongated opening along one side of the compartment, and that the inner conductor is suspended within the tubular compartment by means of dielectric support means.

In the following present invention is described in more detail, partly in connection with a non-limiting embodiment of the invention together with the attached drawings, where

DETAILED DESCRIPTION OF THE PREFERRED EMBODIMENTS

Figure 1:
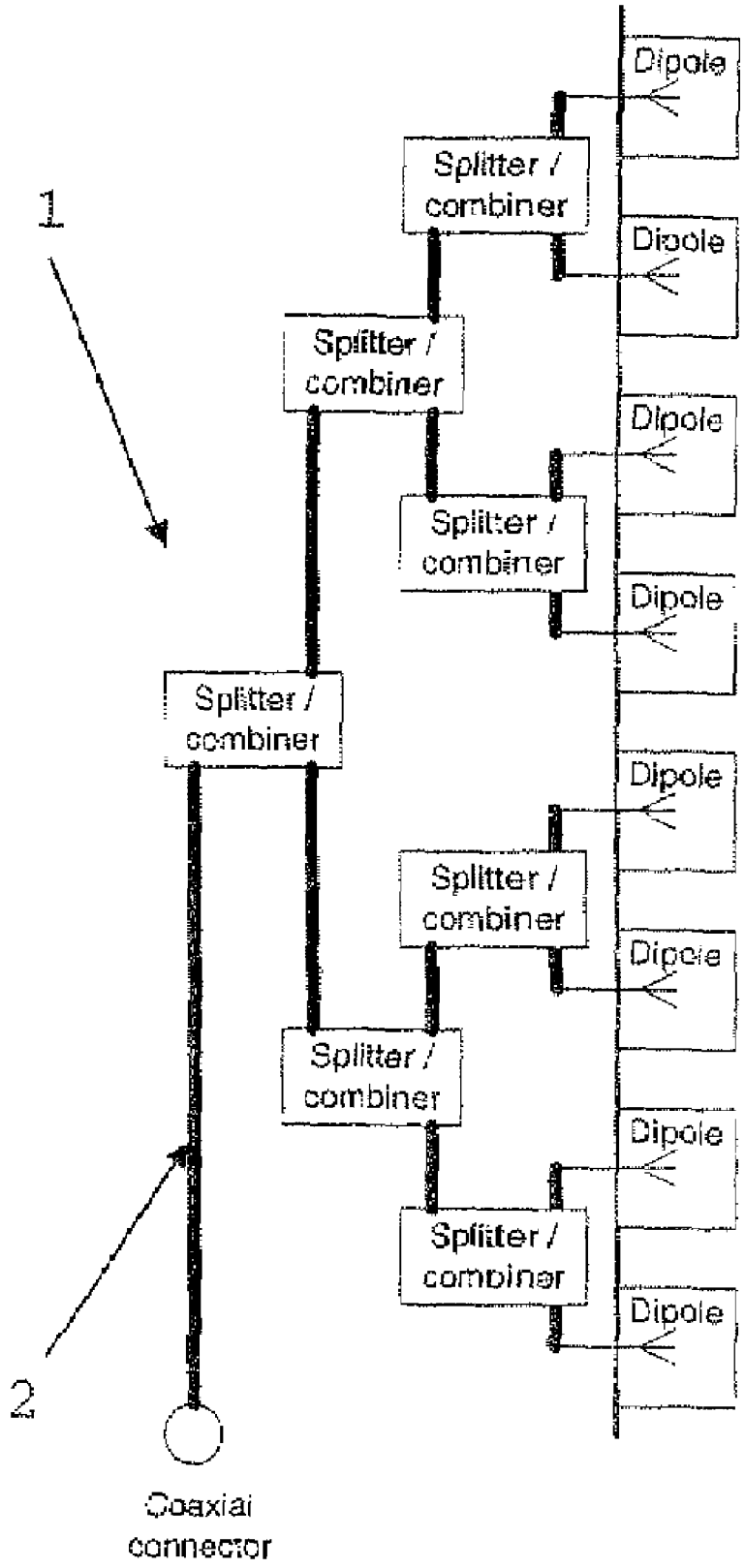
FIG. 1 shows a schematic view of the antenna feeding network.
Figure 3:
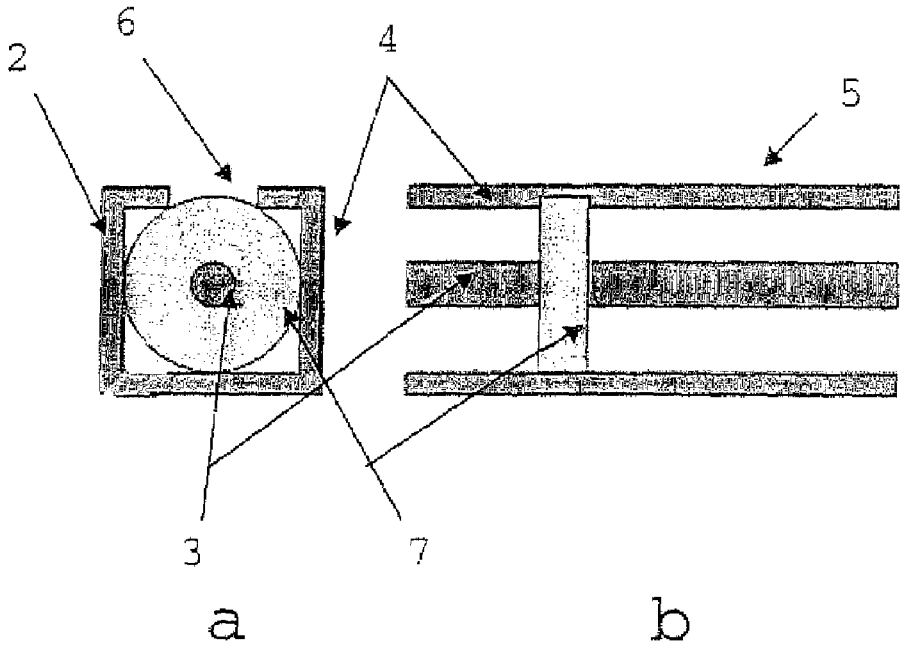
FIG. 3*a* shows a coaxial line of present invention with an elongated opening in a cross-section view.
FIG. 3*b* shows a coaxial line of present invention in a longitudinal cross-section view.

FIGS. 1 and 3 show present invention that refers to an antenna feeding network 1. FIG. 1 shows a typical antenna where the thicker lines represent transmission lines, also called feeding lines. These feeding lines are usually realized using coaxial lines 2. Each coaxial line 2 comprises a central inner conductor 3 and a surrounding outer conductor 4 with some kind of dielectric support means 7 in between, see FIG. 3. The material in the dielectric support means 7 could preferably be a polymer, such as PTFE.

Figure 2:
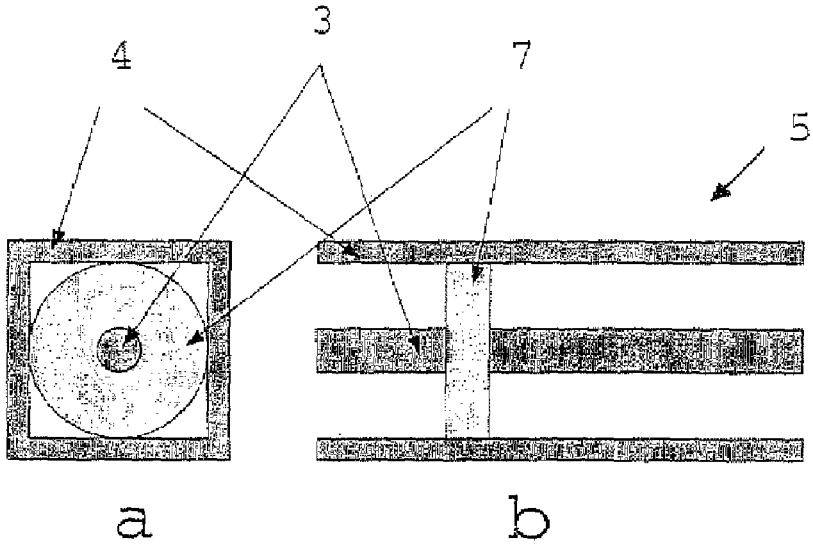
Figure 2 PRIOR ART
FIG. 2*a* shows a coaxial line in a cross-section view of prior art.
FIG. 2*b* shows a coaxial line in a longitudinal cross-section view of prior art.

According to present invention the outer conductor 4 is made of an elongated tubular compartment 5 having an elongated opening 6 along one side of the compartment 5, and the inner conductor 3 is suspended within the tubular compartment 5 by means of dielectric support means 7, see FIG. 3 and compare with FIG. 2 where there is no elongated opening 6.

FIG. 3 further shows that the dielectric support means 7 and the inner conductor 3 are insertable into the elongated tubular compartment 5 from the ends of the compartments 5 Thus, having an opening in the outer conductor helps to easily move the dielectric support means 7 and improve the matching of the antenna. As the opening 6 is parallel with the electrical currents, there is little impact on the impedance of the coaxial line. Instead of machining the inner conductor 3 for changing its impedance dielectric support means 7, in the form of cylindrical pieces, are used and as mentioned preferably made of the polymer material PTFE. These support means 7 serve two purposes. Firstly the support means 7 are used to maintain the inner conductor 3 in the middle of the compartment 5. Secondly the support means 7 are used to match the transmission lines.

The dielectric support means 7 are preferably spacedly positioned along the inner conductor 3. The dielectric support means 7 are movable on the inner conductor 3, within the elongated tubular compartment 5. Further, the dielectric support means 7 are positioned at the desired position on the inner conductor 3 and will be fastened at desired locations therein.

Figure 4:
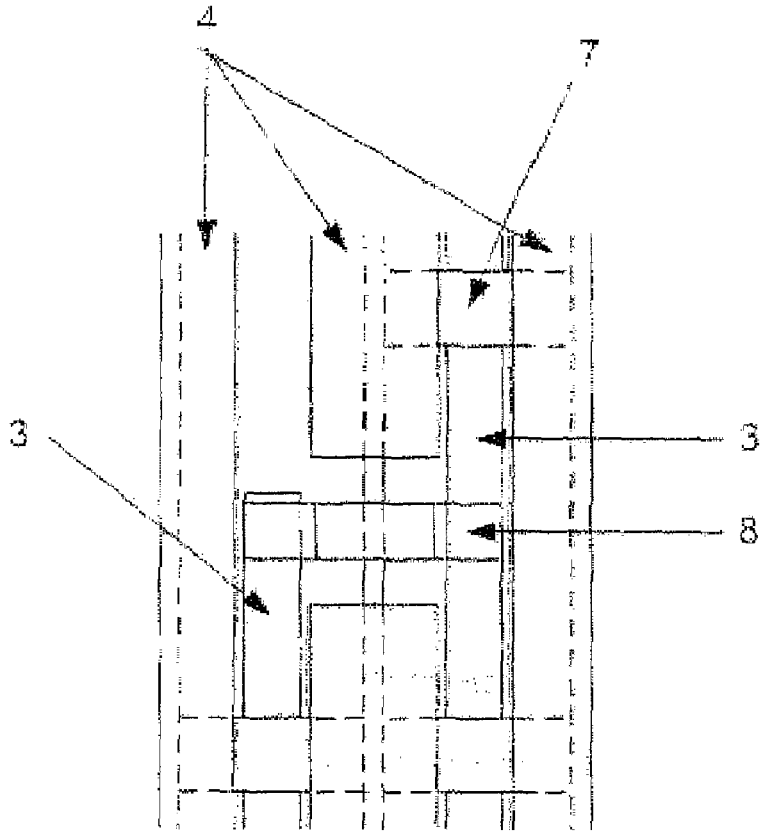
FIG. 4*a* shows a top view of the connection between two coaxial lines of present invention.
FIG. 4*b* shows a cross-section view of the connection between two lines of present invention.
Figure 4:
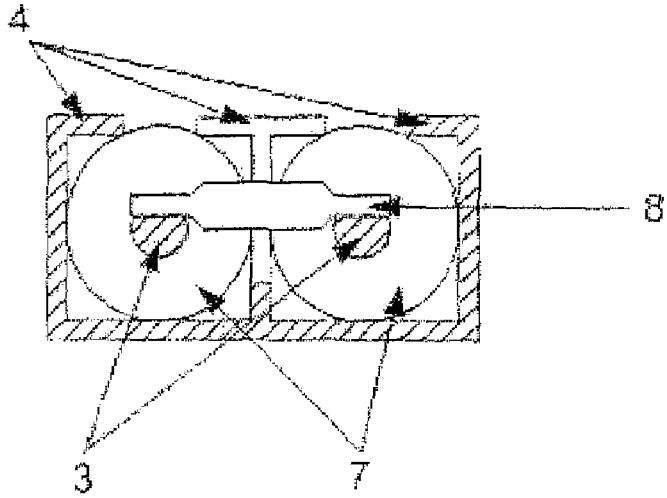

FIGS. 4*a-b* show the inner conductors 3 of adjacent compartments 5. Where two lines need to be connected, the wall between the two compartments is removed along a short distance. A cross-over element 8 is then placed in this opening, and connected to the lines on each side of the wall. The cross-over is designed in such a way, in conjunction with the dimensions of the coaxes and the opening between the two coaxes, that the characteristic impedance is preserved. The cross-over element 8 may be connected to the lines by different methods, for example by means of screws, soldering, gluing or a combination thereof, see FIGS. 4*a-b*. The inner conductors 3 are easily accessible from the top. This makes assembly considerably easier.

Figure 5:
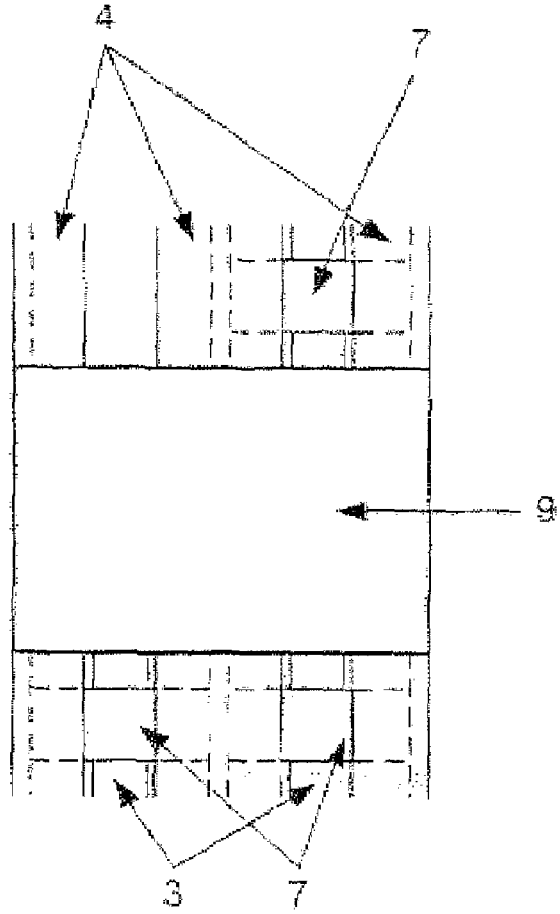
FIG. 5*a* shows a top view of an elongated tubular compartment including the conductive cover of present invention.
FIG. 5*b* shows a cross-section view of an elongated tubular compartment including the conductive cover of present invention.
Figure 5:
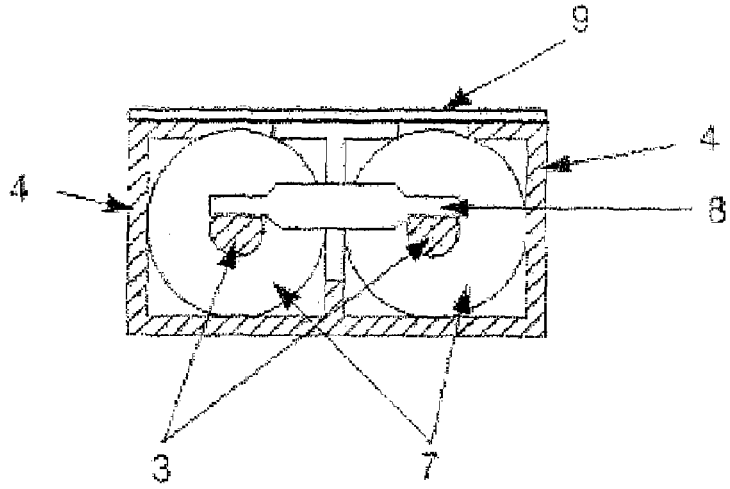

FIGS. 5*a-b* show the compartments 5 at the cross-over element 8 that is covered by a conductive cover 9. Because currents are no longer parallel with the lines 2 near the cross-over, covering the cross-over element 8 with a small-sized metallic surface makes currents travel also in a direction perpendicular to the lines 2. The rest of the lines 2 do not need a conductive cover 9.

In one embodiment the antenna uses different diameters of the inner conductor 3 to achieve impedance matching.

In another embodiment the antenna uses a combination of different inner conductor diameters and dielectric cylinders to achieve impedance matching, see FIG. 5*b*.

In another embodiment a cover 9 consists of a metallic cover along the whole of the elongated opening 6 of the compartment 5.

In yet another embodiment there is a metallic conductive cover 9 covering the cross-over element 8. The rest of the lines 2 do not need a conductive cover 9, but can be covered by means of an environmental protection cover made in an inexpensive material such as, but not limited to, plastic.

In another embodiment the conductive cover 9 can be electrically connected to the outer conductor 4, or it can be isolated from the outer conductor 4 using a thin isolation layer.

Figure 6:
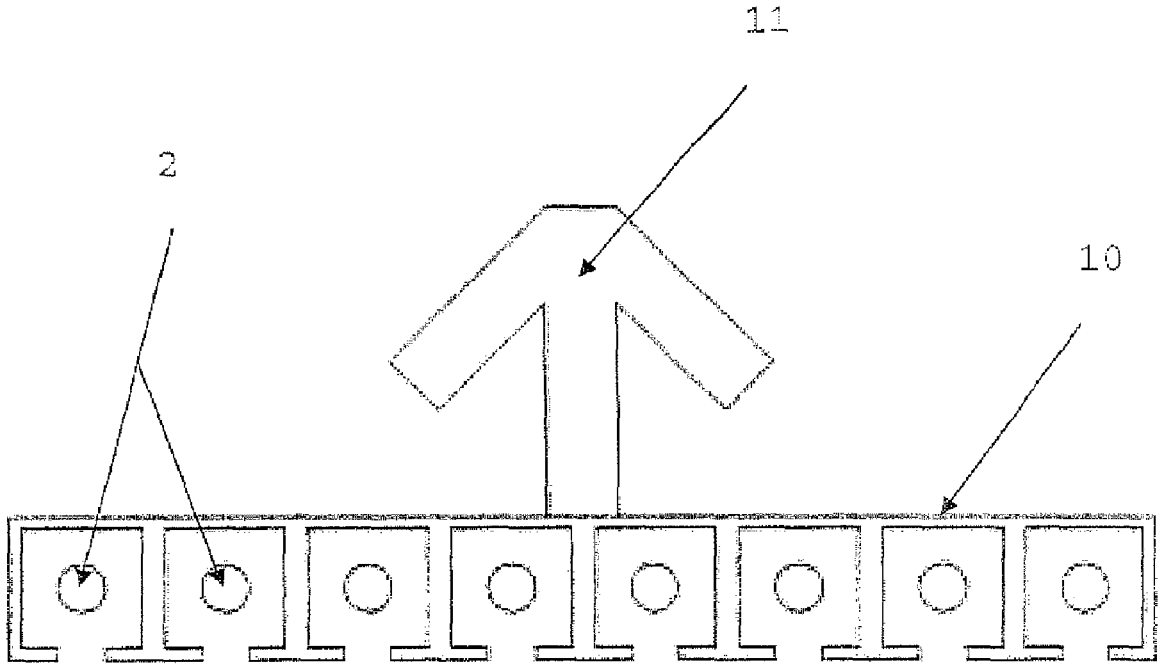
FIG. 6 shows schematically coaxial lines serving as a reflector for the dipoles.

FIG. 6 shows the feeding network 1, in detail the compartments 5 of the coaxial lines 2, that is used as a reflector 10 for dipoles 11 in a communication antenna 1. The compartments of the coaxial lines together with the reflector form a self-supporting framework. Hence it is no longer necessary to have a separate frame.

Above, several embodiments of antenna feeding network have been described. However, present invention can be used in any configuration of antenna feeding network where the impedance losses and matching can be compensated for by a coaxial line according to the invention.

Thus, the present invention shall not be deemed restricted to any specific embodiment, but can be varied within the scope of the claims.

The invention claimed is:

1. An antenna feeding network (1), comprising:

at least one antenna feeding line, each antenna feeding line comprising a coaxial line (2) having a central inner conductor (3) and a surrounding outer conductor (4), wherein, the outer conductor (4) is made of an elongated tubular compartment (5) having an elongated opening (6) along one side of the compartment (5), the elongated opening (6) being elongated in a direction parallel to said coaxial line (2), the inner conductor (3) is suspended within the tubular compartment (5) by a dielectric support (7), and the elongated opening (6) is dimensioned to permit said dielectric support (7) to be accessed and displaced along said coaxial line (2).

2. The antenna feeding network (1) according to claim 1, wherein the elongated tubular compartment (5) is of square cross-section.

3. The antenna feeding network (1) according to claim 2, wherein the dielectric support (7) is movable within the elongated tubular compartment (5) and securable at desired locations within the elongated tubular compartment (5).

4. The antenna feeding network (1) according to claim 2, wherein the inner conductors (3) of adjacent compartments (5) are connectable to each other by a cross-over element (8) inserted through an opening in a wall between the adjacent compartments (5).

5. The antenna feeding network (1) according to claim 4, wherein the compartments (5) at the cross-over element (8) are covered by a conductive cover (9).

6. The antenna feeding network (1) according to claim 1, wherein the dielectric support (7) is movable within the elongated tubular compartment (5) and securable at desired locations within the elongated tubular compartment (5).

7. The antenna feeding network (1) according to claim 6, wherein the inner conductors (3) of adjacent compartments (5) are connectable to each other by a cross-over element (8) inserted through an opening in a wall between the adjacent compartments (5).

8. The antenna feeding network (1) according to claim 7, wherein the compartments (5) at the cross-over element (8) are covered by a conductive cover (9).

9. The antenna feeding network (1) according to claim 1, the inner conductors (3) of adjacent compartments (5) are connectable to each other by a cross-over element (8) inserted through an opening in a wall between the adjacent compartments (5).

10. The antenna feeding network (1) according to claim 9, wherein the compartments (5) at the cross-over element (8) are covered by a conductive cover (9).

11. The antenna feeding network (1) according to claim 10, wherein the conductive cover (9) is connected to the outer conductor (4).

12. The antenna feeding network (1) according to claim 10, wherein the conductive cover (9) has an insulating layer.

13. The antenna feeding network (1) according to claim 1, wherein the side of the compartment (5) having the elongated opening (6) is covered by a plastic environmental protection cover.

14. The antenna feeding network (1) according to claim 1, further comprising:

a dipole (11), wherein a plurality of coaxial lines (2) form a reflector (10) for the dipole (11) in a communication antenna (1).

15. The antenna feeding network (1) according claim 14, wherein the tubular compartments (5) of the plurality of coaxial lines (2) and the reflector (10) form a self-supporting framework.

16. An antenna feeding network (1), comprising:

an inner conductor (3) having a length;

a dielectric support (7) completely surrounding a cross section of the inner conductor (3) and supporting the inner conductor (3); and an outer conductor (4) defining an elongated tubular compartment (5) surrounding the dielectric support (7) along the length, the tubular compartment (5) having an elongated opening (6) through the tubular compartment (5), the elongated opening (6) extending along the length and on one side of the tubular compartment (5) and configured to permit the dielectric support (7) to be accessed and displaced along the length of the inner conductor (3), wherein the inner conductor (3), the dielectric support (7), and the outer conductor (4) form a coaxial line (2).

17. The antenna feeding network (1) according to claim 16, wherein the tubular compartment (5) and the dielectric support (7) form a plurality of disconnected spaces therebetween.

18. The antenna feeding network (1) according to claim 17, wherein the tubular compartment (5) has a rectangular shape in cross-section.

19. The antenna feeding network (1) according to claim 16, wherein the dielectric support (7) completely surrounds the inner conductor (3) in contact with the inner conductor (3) along the length of the inner conductor (3).

20. The antenna feeding network (1) according to claim 16, wherein the dielectric support (7) is configured to be movable within the tubular compartment (5), and further configured to be secured at one or more locations within the tubular compartment (5).

* * * * *